US005504395A

United States Patent [19]

Johnson et al.

[11] Patent Number: 5,504,395

[45] Date of Patent: Apr. 2, 1996

[54] LAMP BULB HAVING INTEGRATED RFI SUPPRESSION AND METHOD OF RESTRICTING RFI TO SELECTED LEVEL

[75] Inventors: Samuel A. Johnson, Eagle, Id.; Patrick Roblin, Worthington, Ohio; Chih-Ju Hung, Columbus, Ohio; Veng-Chong Lau, Columbus, Ohio

[73] Assignee: Beacon Light Products, Inc., Meridian, Id.

[21] Appl. No.: 202,368

[22] Filed: Mar. 4, 1994

Related U.S. Application Data

[63] Continuation-in-part of Ser. No. 27,855, Mar. 8, 1993.

[51] Int. Cl.[6] ..... H05B 39/04

[52] U.S. Cl. ..... 315/71; 315/307; 315/72; 315/73; 323/908; 323/238; 307/157

[58] Field of Search ..... 315/73, 72, 71, 315/58, 62, 307, 70, 57; 439/620, 611, 612; 323/908, 240, 238; 307/157

[56] References Cited

U.S. PATENT DOCUMENTS

| | | | |
|---|---|---|---|
| Re. 31,848 | 3/1985 | Nilssen | 315/360 |
| 1,297,879 | 3/1919 | Lorenz | 315/71 |
| 3,525,012 | 9/1967 | Copoulos et al. | 315/70 |
| 3,684,919 | 8/1972 | Cramer | 315/194 |
| 3,697,821 | 10/1972 | Johnson | 307/112 X |
| 3,808,456 | 4/1974 | Kay et al. | 307/140 |
| 3,818,263 | 6/1974 | Belko | 315/32 |
| 3,823,339 | 7/1974 | Borneman | 315/69 |
| 3,939,361 | 2/1976 | Aidala | 307/141 |
| 3,952,242 | 4/1976 | Ukai | 323/21 |
| 3,975,658 | 8/1976 | Emtage et al. | 315/71 |
| 4,011,482 | 3/1977 | Seib | 315/361 |
| 4,087,723 | 5/1978 | Chermin et al. | 315/207 |
| 4,090,107 | 5/1978 | Seib | 315/156 |
| 4,099,099 | 7/1978 | Grüdelbach | 315/194 |
| 4,118,654 | 10/1978 | Ohta | 40/361 |
| 4,155,015 | 5/1979 | Nakasone | 307/252 B |
| 4,165,475 | 8/1979 | Pegg et al. | 315/99 |
| 4,181,872 | 1/1980 | Chermin | 315/106 |
| 4,204,149 | 5/1980 | Cleary et al. | 323/24 |
| 4,259,619 | 3/1981 | Wall | 315/361 |
| 4,276,486 | 6/1981 | Ahuja | 307/252 B |
| 4,276,542 | 6/1981 | Russ | 340/326 |
| 4,322,632 | 3/1982 | Hart et al. | 307/41 |
| 4,504,778 | 3/1985 | Evans | 323/323 |
| 4,527,099 | 7/1985 | Capewell et al. | 315/291 |
| 4,591,765 | 5/1986 | Beck | 315/361 |
| 4,613,790 | 9/1986 | Roorda | 315/72 |
| 4,628,230 | 12/1986 | Krokaugger | 315/307 |
| 4,634,957 | 1/1987 | Hollaway | 323/242 |
| 4,644,226 | 2/1987 | Vernooij | 315/50 |
| 4,668,877 | 5/1987 | Kunen | 307/116 |
| 4,695,739 | 9/1987 | Pierce | 307/14 |
| 4,804,916 | 2/1989 | Frank | 323/300 |
| 4,928,055 | 5/1990 | Kaieda | 323/300 |
| 4,988,921 | 1/1991 | Ratner | 315/159 |
| 5,030,890 | 7/1991 | Johnson | 315/208 |
| 5,126,634 | 6/1992 | Johnson | 315/71 |
| 5,214,354 | 5/1993 | Johnson | 315/71 |
| 5,264,761 | 11/1993 | Johnson | 315/291 |

*Primary Examiner*—Benny T. Lee
*Assistant Examiner*—Arnold Kinkead
*Attorney, Agent, or Firm*—John R. Ley

[57] ABSTRACT

An incandescent lamp bulb which is driven by an electronic control module (ECM) and method of manufacture characterized in that an inductor comprising a magnetic element and a winding thereon is disposed within a screw shell base of the lamp bulb and surrounds the lamp exhaust tube therein. One end of the winding on the magnetic element is connected to a filament wire within the screw shell base and the other end of the inductive winding is connected to an output terminal of the ECM control module. In this manner, the inductor significantly reduces the di/dt rise time of voltage and current when a triac within the ECM module is driven to conduction on each one half cycle of the applied AC line voltage. This operation in turn produces a substantial reduction in radio frequency interference, both of radiation transmitted into space from the lamp bulb and by direct DC coupling back into the AC line voltage source. In a preferred embodiment, the di/dt rise time is calculated mathematically based on a Fourier series transformation of the current conducted through the filament by the triac.

16 Claims, 10 Drawing Sheets

Fig_14
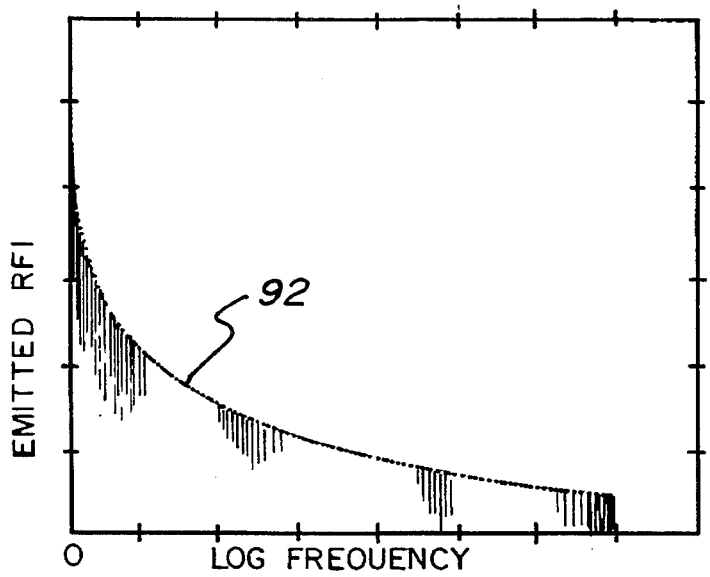
Fig_15
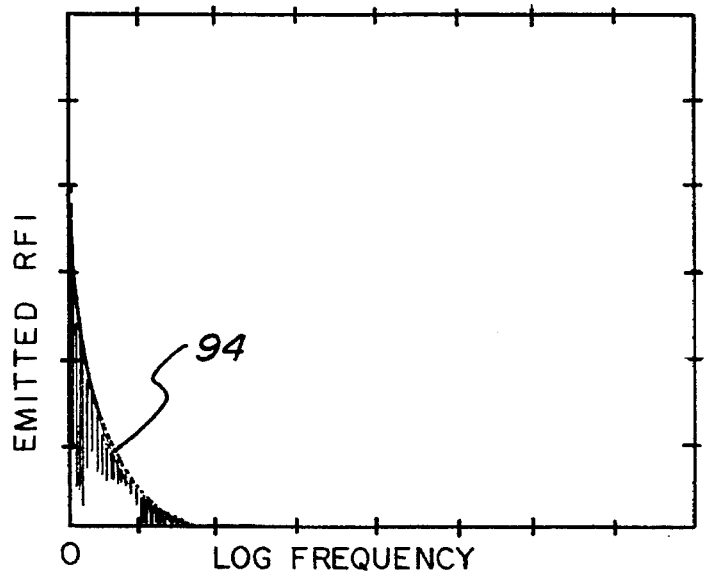
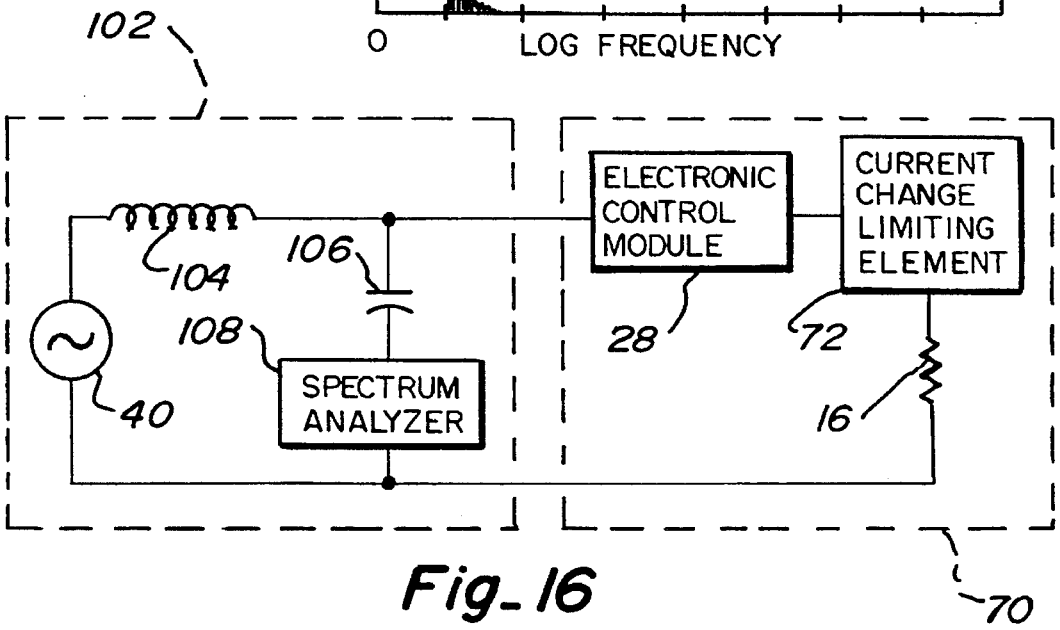
Fig_16

LAMP BULB HAVING INTEGRATED RFI SUPPRESSION AND METHOD OF RESTRICTING RFI TO SELECTED LEVEL

CROSS REFERENCE TO RELATED APPLICATION

This is a continuation-in-part of U.S. patent application Ser. No. 08/027,855, filed on Mar. 8, 1993, entitled "Lamp Bulb Having Integrated Lighting Function Control Circuitry and Method of Operation", by the inventor hereof and assigned to the assignee hereof.

TECHNICAL FIELD OF THE INVENTION

This invention relates generally to incandescent lamps and other lighting devices, and more particularly, to a new and improved incandescent lamp which integrates radio frequency interference (RFI) and lighting control functionality to effectively confine the emitted RFI within acceptable health and electrical code standards.

BACKGROUND ART AND RELATED INVENTIONS

In U.S. Pat. No. 5,030,890 entitled "Two Terminal Incandescent Lamp Controller", issued Jul. 9, 1991, there are disclosed and claimed new and useful improvements in the field of controlling various lighting functions of an incandescent lamp bulb, such as timing, duty cycle control, dimming and illumination intensity. This two terminal incandescent lamp controller is operative to provide in memory certain data values corresponding to the timing or sequence at which power interruptions to the memory may occur. Timed or sequenced power interruptions to the memory are created in order to select a particular data value for storage in memory which is then operative to control either the conduction time, the duty cycle, or the illumination intensity of the lamp bulb. This conduction time, duty cycle, or illumination intensity control is achieved by connecting an AC triggerable switch, such as a triac, to the lamp and controlling its conductive state by the application thereto of the particular data value selected for storage in the memory of a microprocessor or a microcontroller.

In a subsequent commonly assigned U.S. Pat. No. 5,126,634 entitled "Electronic Control Module (ECM) for Controlling Lighting Functions of a Lamp Bulb and Method of Manufacture" there are disclosed and claimed further new and useful improvements in the field of lamp bulb function control. These improvements include, among other things, a new and improved process for manufacturing an integrated circuit controlled light bulb. This manufacturing process includes the steps of providing a light bulb having a filament wire therein and a dielectric insulator at one end of the bulb, with the insulator having a recessed cavity adjacent to which an opening extends to an interior section of the bulb. An electronic control module (ECM) is mounted in this receptacle and then connected to a filament wire of the bulb for thereby controlling one or a plurality of bulb lighting functions in response to the operation of the electronic control module.

In yet a subsequently filed and commonly assigned U.S. application Ser. No. 07/847,179 entitled "Lamp Bulb With Integrated Bulb Control Circuitry and Method of Manufacture", filed Mar. 9, 1992, now U.S. Pat. No. 5,214,354, there are disclosed and claimed yet still further new and useful improvements in the field of electronic control module design wherein a new and improved ECM article of manufacture is constructed having a metal housing with a base or floor member being surrounded by an upstanding wall member defining an opening in the housing. A ceramic substrate is mounted on the base member, and bulb lighting control circuitry is constructed on the substrate and has a conductive bridge member connected thereto for transmitting control signals from a microprocessor or microcontroller in the bulb lighting control circuitry to the filament of a light bulb. This application and the above two patents preceding it are incorporated herein by reference.

Whereas the above identified inventions represent most significant advances in the fields of lamp bulb manufacture and associated lighting function control, the operation of the triac in the ECM module in response to the microprocessor or microcontroller can, in some cases, generate undesirable radio frequency interference (RFI) radiation. This RFI is generated as a result of the steep di/dt rise time due to the triac turn-on from voltage on each one-half cycle of the AC line which is applied across the anode and cathode terminals of the triac. This undesirable radio frequency interference can be radiated as RF signals from the lamp bulb acting as an antenna and into the surrounding ambient, and it can also be transmitted directly back through the AC line voltage source to thus provide electrical interference to other appliances connected to this same source of AC voltage. In either case, this radio frequency interference is undesirable and may in some cases exceed acceptable electrical and health code levels for RFI in certain countries.

The electrical and health code which governs acceptable levels of RFI define maximum allowable magnitudes of radiated and conducted RFI relative to the frequency at which the RFI is radiated. Conducted RFI will propagate back through the system wiring, which may be several tens of kilometers. This long length of wiring thus forms a very efficient transmitter of RFI. Also, it is much easier for conducted RFI to enter sensitive electronic equipment through a plug-in power cord. The relative magnitude of the radiated RFI is important because the strength of the RFI is directly related to the potential risk. However, higher frequency RFI can be radiated over greater distances and will achieve greater penetration than the RFI radiated at relatively lower frequencies. Consequently, the risk associated with RFI relates to both the magnitude of the RFI and the frequency at which the RFI is generated. Accordingly, the electrical code establishes different maximum RFI levels at different frequencies. At higher frequencies, the maximum allowable RFI levels are of lower than the maximum allowable RFI levels at lower frequency levels.

Conventional dimmer control devices are a source of conducted RFI. Dimmers are usually used with lighting and other devices to control the intensity of light or some other aspect of operation of the device which the dimmer controls. These dimmers usually include some type of controllable switch, such as a SCR or triac, which conducts current to the light or other device in a controllable manner by turning on and off almost instantaneously. This type of switching results in abrupt or step waveform of current conducted by the light or the device which is controlled. Measured di/dt values of this step are greater than $10^7$ amperes per second. The inherent characteristic of such step waveforms is the generation of a variety high frequency signals of varying magnitudes. In fact, the step waveform is a composite of signals of generally increasing frequencies and diminishing magnitudes.

Conventional dimmers often include filters to diminish the magnitude of the switching signals which cause RFI. Since dimmers are typically intended to permit operation with a variety lights and devices of different power ratings, the filtering capability must accommodate a relatively wide range of different loads. In order to accommodate the range of different loads, the filter may be incapable of sufficiently suppressing RFI when the dimmer is lightly loaded and allowed to resonate.

It is with respect to these considerations and other background information relative to lighting devices having light function control circuitry that the significant improvements of the present invention have evolved.

SUMMARY OF INVENTION

The general purpose and principal object of the present invention is to provide a significant reduction in the RFI emitted from ECM- or other switch-controlled lamp bulbs or lighting devices and a lamp which is compatible with both the typical lamp bulb manufacturing process and also with the integrated ECM disclosed in the above identified U.S. Pat. No. 5,214,354.

Another object of this invention is to provide a new and improved lamp bulb and assembly process which utilizes existing space and construction within a screw shell base of the lamp bulb in order to integrate the ECM and a RFI filter therein, while simultaneously adding only a minimal additional cost to the overall lamp bulb and assembly process.

Another object of this invention is to provide a new and improved lamp bulb with integrated RFI suppression capability, which is capable of operating with one or a plurality of lighting control functions.

Another object of this invention is to provide a new and improved triac control circuit for use with an ECM module mounted in the screw shell base of a lamp bulb.

A further object of this invention is to provide a new and improved lamp bulb with integrated RFI suppression capability, which includes circuitry capable of optimally attenuating the RFI generated by the lamp bulb itself when used in switching lighting control applications.

The above purposes and objects are accomplished by, among other things, providing a current limiting element such as a magnetic spool, bobbin, or toroidal inductor, having an opening or passageway therethrough, with the current limiting element being precisely sized to fit into the screw shall base of a lamp bulb. When the current limiting element is formed of a magnetic spool, the spool has one unprotected metal end sized to fit into the interior of the screw shell base and the other metal end surrounded by a cylindrical insulating sleeve or ring which is sized to receive an insulating cap with an opening through its outer surface. The insulating sleeve and cap are together sized to engage and hold the ECM in a fixed position on the other metal end of the spool. A winding carried on the spool is connected at one end to the ECM, and when the spool in inserted into the screw shell base, the other end of the winding is connected to a filament wire of the lamp bulb. In this manner, the combination magnetic spool and winding provides a relatively large inductor, which is connected in series between the lamp bulb filament and the ECM and thus across the AC line. This large inductor is one example of a current and current-change limiting element which substantially reduces the di/dt rise time of current in this series circuit on each conductive one-half cycle of a triac within the ECM. The current limiting element substantially reduces RFI both emitted from the lamp bulb acting as an antenna and directly conducted back into the AC line.

The construction of an inductor assembly can be accomplished by a variety of methods. In the simplest form, a coil of fine wire having adequate inductive properties with only an air core gives the amount of inductance required for satisfactory RFI filtering action. However, as a practical matter, obtaining the required inductance necessary for RFI reduction dictates increasing the inductance per unit volume. By utilizing a magnetic concentrating material such as soft iron or steel or a ferrite, the inductance per given number of turns can be increased by orders of magnitude.

In a preferred aspect of the invention, a lamp bulb assembly process includes the steps of: providing an incandescent lamp bulb having a screw shell base into which an elongated lamp exhaust tube and a pair of filament wires extend from within the bulb; inserting a magnetic spool with an inductive winding thereon into the screw shell base; attaching an ECM to one end of the spool; connecting one end of the inductive winding to one of the filament wires within the bulb; and connecting the other end of the inductive winding to an output terminal of the ECM.

In accordance with another preferred aspect of the invention, a unitary incandescent lamp for use in controlled lighting functions such as timing, illumination, intensity, and duty cycle control, comprises a filament, a lamp exhaust tube, and a pair of filament wires extending into a screw shell base which is secured to an end section of the glass bulb. A current change limiting element in integrally formed as a part of the lamp. The current change limiting element, such as a magnetic spool, is preferably mounted within the screw shell base and has an opening therein surrounding the lamp exhaust tube. A winding on the spool is connected at one end to one of the filament wires. The other end of the winding may be connected to an output terminal of the ECM, if employed in the lamp.

In accordance with another preferred aspect of the invention, the lamp bulb filament, the current change limiting element or inductor, and the ECM, if employed, are all connected in series across an AC line, with a capacitor optionally connected in parallel with the inductor and the ECM. The capacitor and other elements form a second order filter having improved RFI attenuation characteristics over those RFI attenuation characteristics achieved by the inductor itself. The inductance of the inductor, the resistance or impedance of the filament and the capacitance of the capacitor, if employed, are selected to achieve the optimal RFI suppression and filtering capable for the lamp bulb of the power capacity established by the filament.

Unlike dimmers which are intended to accommodate lighting devices within a wide range of wattage ratings, the RFI suppression capability integrated into the lamp bulb is optimized for only a single size lamp bulb. Accordingly the amount of RFI suppression from the lamp bulb is maximized with use of smaller and less costly components. Appropriate selection of the filter and current change limiting elements ensures that the RFI generated during operation of the lighting function control circuitry is less than maximum amount permitted by the electrical or health code which governs levels of RFI.

The above brief summary of the invention, together with its attendant objects, advantages, and novel features, will become more readily apparent in the following description of the accompanying drawings, from the following detailed description of the preferred embodiments and from the appended claims.

BRIEF DESCRIPTION OF THE DRAWINGS

FIG. 14 is a graph illustrating the noise spectrum of the RFI generated during operation of the lamp bulb shown in FIG. 11 when the switched current rate of change is relatively large.

FIG. 15 is a graph illustrating the noise spectrum of the RFI generated during operation of the lamp bulb shown in FIG. 11 when the switched current rate of change is relatively small.

FIG. 16 is a partial circuit, partial functional block diagram of circuitry which measures parameters used to determine required sizing of the current change limiting element shown in FIG. 11.

DETAILED DESCRIPTION OF PREFERRED EMBODIMENTS

Figure 1:
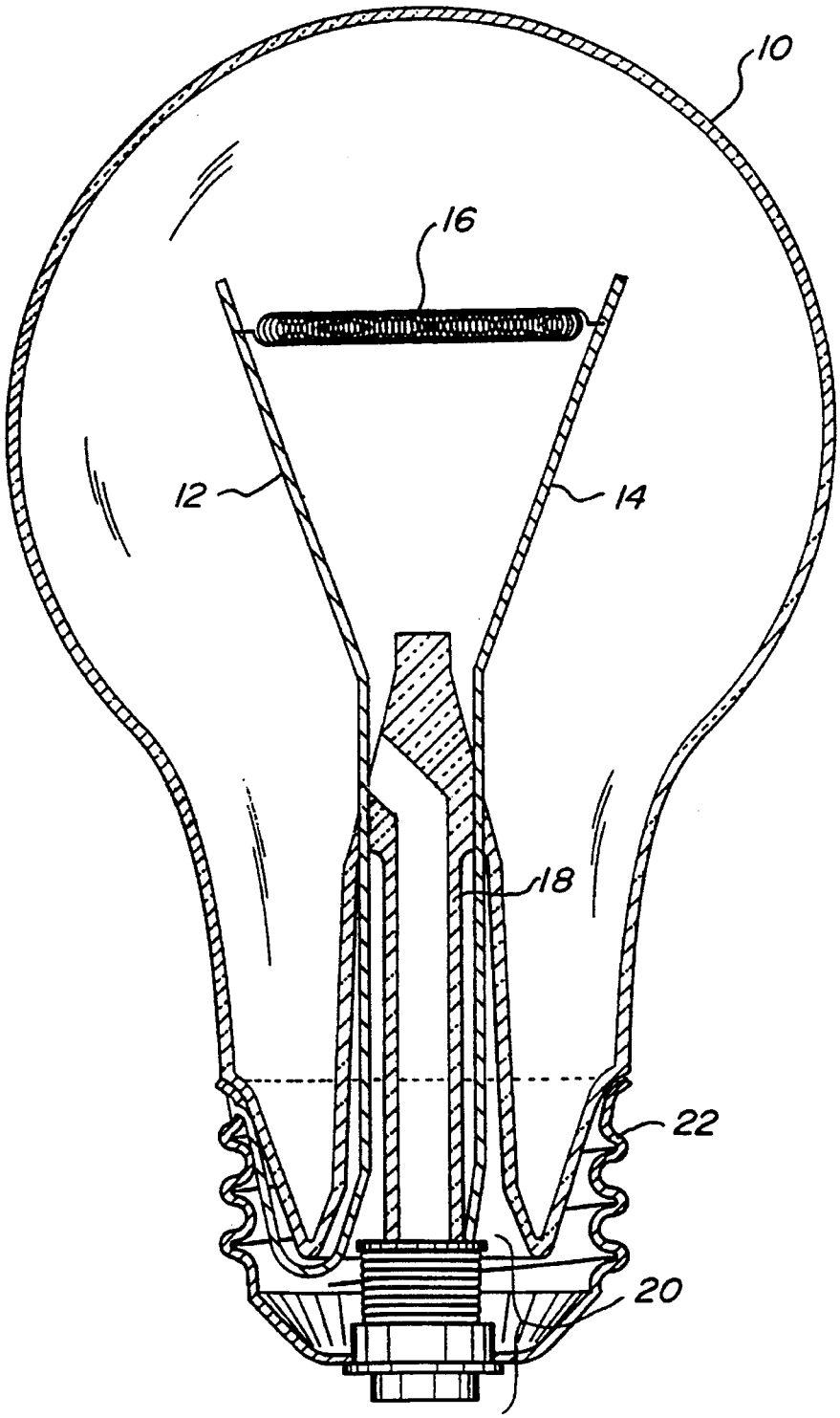
FIG. 1 is a section view of an incandescent lamp bulb which has been constructed as a preferred embodiment of the present invention.

Referring now to FIG. 1, an incandescent lamp bulb shown therein includes an outer glass or other light-passing translucent housing 10 surrounding a pair of filament wires 12 and 14 between which a filament 16 is connected in conventional fashion. An elongated lamp exhaust tube 18 is centrally located between the filament wires 12 and 14, and a magnetic spool and inductor assembly designated generally as 20 is mounted in the lower end of the lamp bulb 10 where it is surrounded as shown by a screw shell base 22. The screw shell base 22 is adapted for connecting the lamp bulb to a conventional electrical socket (not shown), as is well known.

Figure 2:
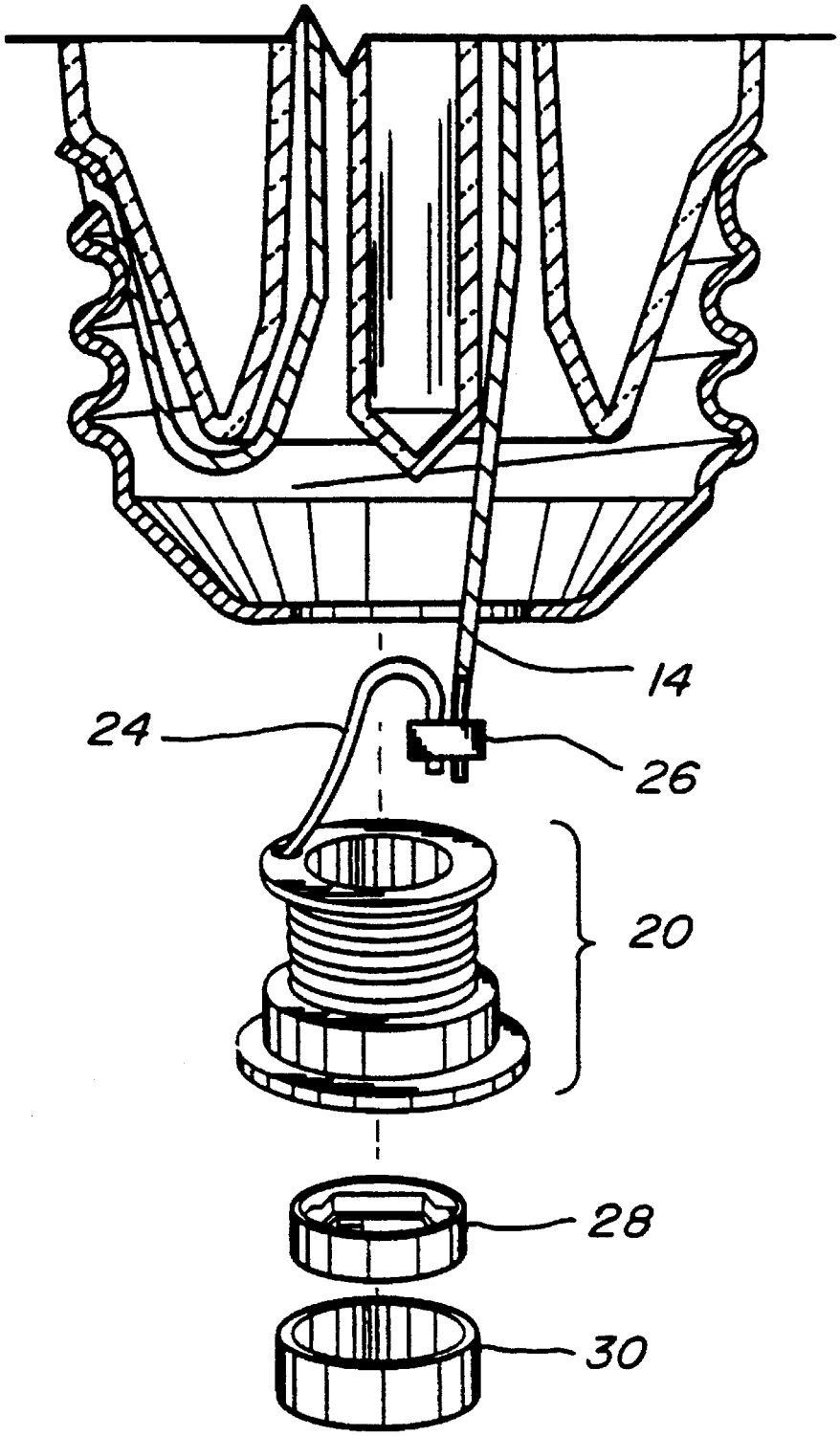
FIG. 2 is an exploded and fragmented perspective view of the lamp bulb shown in FIG. 1, showing a RFI inductor assembly mounted and connected to a screw shell bulb base and filament wires.

Referring now to FIG. 2, this fragmented and partially exploded perspective view shows the connection of the magnetic spool and inductor assembly 20, with the one end 24 of the inductor coil being connected through a connector 26 to one end of the filament wire 14. An electronic control module (ECM) 28 is concentrically positioned in a recess along the central longitudinal axis of the inductor and spool assembly 20, and a retaining member 30 is used to hold the ECM 28 in position within the interior of the magnetic spool and inductor assembly 20. The ECM 28 is preferably of the type disclosed in the above identified U.S. Pat. No. 5,126,634.

Figure 3:
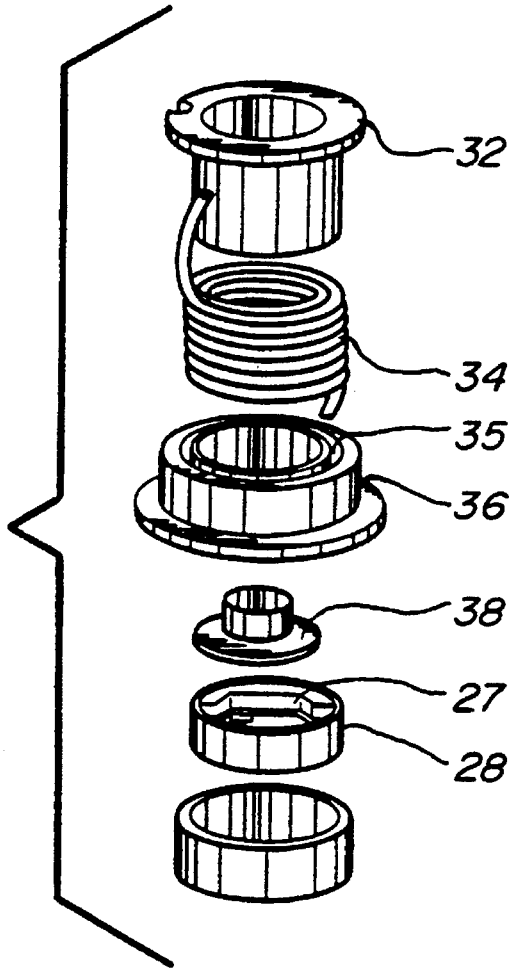
FIG. 3 is an exploded perspective view of the major components of an inductor assembly shown in FIGS. 1 and 2.

Referring now to FIG. 3, this perspective view further explodes all of the six major components within the inductor and spool assembly 20 shown in FIG. 2 and includes an upper bobbin member 32 around which an inductive coil 34 of wire is wound. The inductive coil 34 is held in place by a cylindrical groove 35 within a lower bobbin member 36. A small conductive eyelet 38 is adapted for positioning between a conductive bridge 27 of the ECM 28, and it serves to connect the conductive bridge 27 to the lower end of the inductive coil 34 of wire. The retaining ring 30 is adapted to be press fit between the outer cylindrical housing of the ECM 28 and the interior walls of the lower bobbin member 36.

Figure 4:
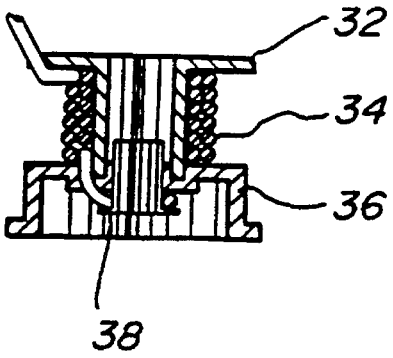
FIG. 4 is a side section view of a coil of wire wound on a magnetic spool of the inductor assembly shown in FIG. 3.

Referring now to FIG. 4, this cut-away cross section view more clearly shows the geometry of the upper and lower bobbin members 32 and 36 and how the inductive coil 34 connects around the exterior walls of the upper bobbin member 32 and into the eyelet 38 to which the conductive bridge 27 of the ECM 28 is connected.

Figure 5:
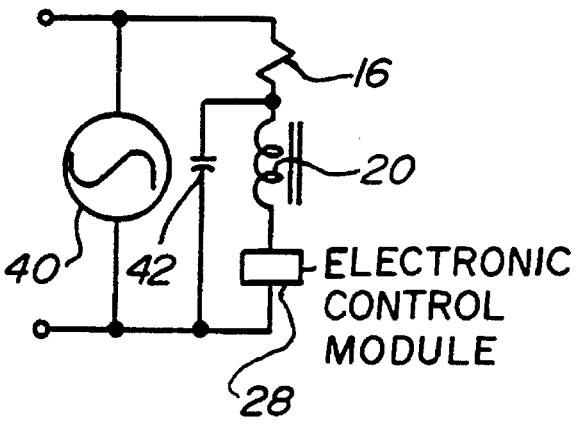
FIG. 5 is a schematic circuit and block diagram of certain components of the lamp bulb including a bulb filament, bulb filament wire, inductor, and an ECM, also showing an optional capacitor connected in parallel with the inductor and the ECM.

FIG. 5 is a schematic circuit diagram showing the lamp bulb filament wire 16, the inductor assembly 20, and the ECM 28 all connected in series across a source 40 of AC line voltage or power. A capacitor 42 may be optionally connected in parallel with the inductor assembly 20 and the ECM 28 in order to form a second order filter having improved RFI attenuation characteristics compared to the RFI attenuation characteristics achieved by the inductor assembly 20 alone.

Figure 6:
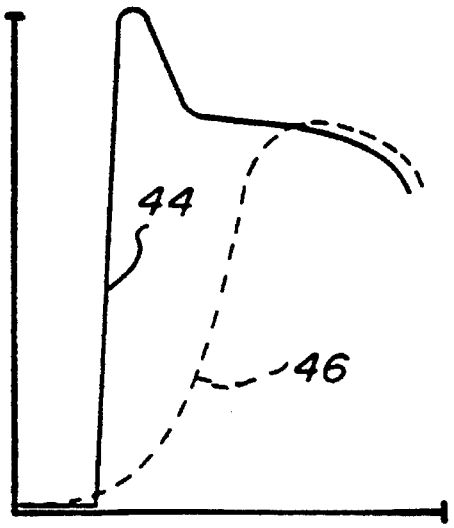
FIG. 6 is graph of a pair of curves of di/dt rise times when using the ECM both with and without the inductive and capacitive filter shown in FIG. 5. The dotted line curve indicates filtering and the steep solid line curve is generated when no filter is used.

FIG. 6 shows two plots of current versus time to the lamp bulb filament 16 in response to the almost simultaneous switching of current through the ECM 28. The solid line graph 44 represents di/dt current conduction without using the inductor assembly 20, and the dotted line graph 46 represents how the di/dt rise time is significantly reduced by using the above circuitry in FIG. 5 and the inductor assembly 20 in accordance with one aspect of the present invention.

Figure 7:
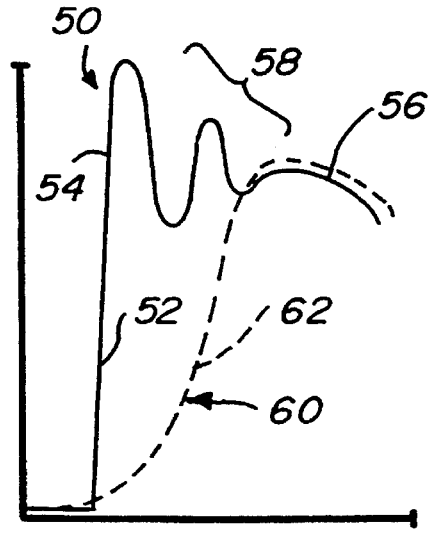
FIG. 7 is a graph of a pair of curves similar to those shown in FIG. 6, illustrating another common cause of radiated RFI in a lamp bulb.

FIG. 7 shows another example of the current conduction of the lamp bulb filament 16 in response to the almost simultaneous switching of current through the ECM 28, when the lamp bulb does not include the RFI suppression capability of the present invention or when a conventional lamp bulb is used with a dimmer which does not include adequate RFI filtering. The solid graph 50 is similar to the solid graph 44 shown in FIG. 6, and illustrates the step-like, almost instantaneous, rise in current at 52. The current rise 52 continues in an initial overshoot 54 above the relatively constant steady state current conductive condition 56 which ultimately results after time. However, prior to reaching the steady state condition 56, the current experiences a period of damped high frequency oscillations 58 which are instituted by the overshoot 52 but which ultimately decay into the steady state condition 56.

The frequency of the oscillations 58 may be relatively high and sufficient to generate unwanted and potentially excessive RFI radiation. In addition the relatively steep current rise 52 will also generate some RFI, because the step-like rising waveform 52 inherently is composed of a composite of increasing frequency signals of diminishing magnitudes, as is known in electrical signal theory. Thus both the step-like rising waveform 52 and the oscillations 58 created by the overshoot 54 are sources of undesirable RFI emissions.

On the other hand, the dashed line graph 60 shown in FIG. 7 illustrates the current smoothing effect of the filtering, current change limiting and RFI suppression capability of the present invention. The graph 60 shows a more gentle and less rapid increase 62 in current flow in response to the near instantaneous switching of the ECM 28. The relatively gentler increase 62 in current creates reduced magnitudes of the higher frequency components of the waveform at 62 compared to the waveform at 52. Consequently the waveform portion at 62 is composed of fewer high frequency signal components and those that do exist are of considerably lower magnitude compared to those at 52. Radiated RFI is reduced because of the gentler slope or rise time of the waveform portion at 62. In addition however, the current flow represented by the graph 60 does not include an overshoot or oscillations as does the graph 50. The absence of the overshoot and oscillations further contributes to the attenuation of emitted RFI.

The graph 60 represents the optimal RFI attenuation characteristics for the lamp bulb. These optimal characteristics are achieved by selection of the values of the inductance for the inductor assembly (FIG. 5) or comparable characteristics of another current change limiting element and selection of the values of the capacitor 42 (FIG. 5) or other filtering elements, if used, relative to the established value of the resistance or impedance of the filament 16. The resistance of the filament 16 is established for each particular size of lamp bulb, since it is the filament which governs the amount of light power supplied by the bulb, in terms of watts. The manner of optimizing the selection of the values of the filtering elements relative to the light power or capacity of the bulb, and the nature of the ECM 28, are described in greater detail below.

Figure 8:
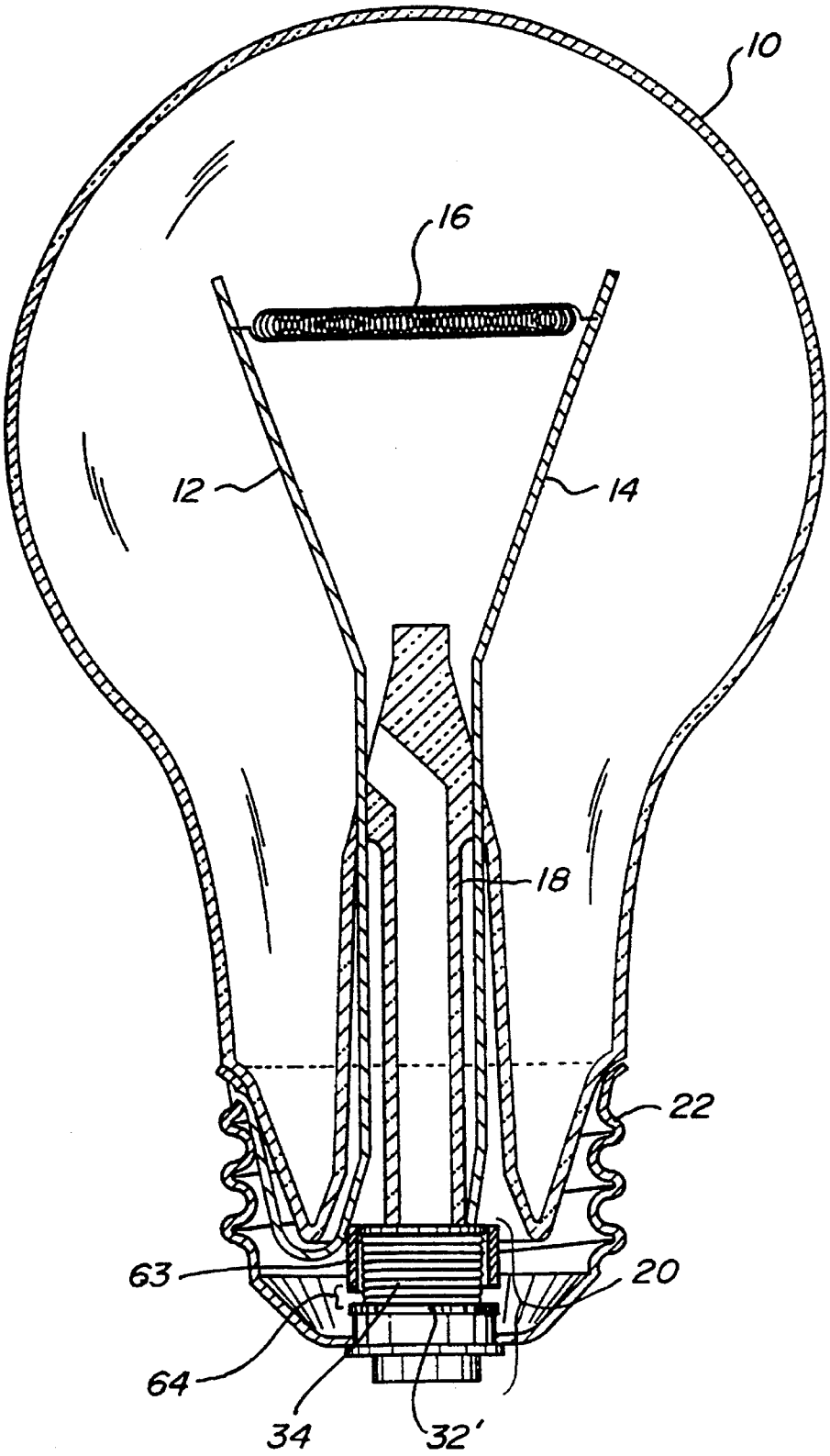
FIG. 8 is a section view of an incandescent lamp bulb which has been constructed as another preferred embodiment of the present invention.

FIG. 8 illustrates an incandescent lamp bulb of another embodiment of the present invention. The incandescent lamp bulb is similar to the incandescent lamp bulb shown in FIG. 1 and includes an outer glass or other light-passing translucent housing 10, a pair of filament wires 12 and 14, a filament 16, an elongated lamp exhaust tube 18, an inductor assembly 20, and a screw shell base 22.

The assembly 20 differs with that of the assembly 20 shown in FIGS. 1–4. FIG. 8 illustrates a bobbin member 32' of a C-shaped cross section about which a winding 34 is wrapped. The bobbin member 32' is formed of a ferromagnetic material. A sleeve member 63 is positioned about the bobbin member 32' and winding 34. The sleeve member 63 is also formed of a ferromagnetic material. The sleeve member 63 is positioned about the bobbin member 32' and winding 34 in a press-fit arrangement and an air gap 64 is preferably maintained between a bottom portion of the bobbin member 32' and the sleeve member 63. The size of the air gap 64 is selected by appropriate sizing of the dimensions of the sleeve member 63 and the bobbin member 32' or by applying a desired amount of pressure upon the sleeve member 63 when positioning the sleeve member 63 in the press-fit arrangement upon the bobbin member 32'. The sleeve member 63 and the bobbin member 32' together form a circulating magnetic flux path wherein the air gap 64 alters the path characteristics to prevent core saturation of the assembly 20.

Figure 9:
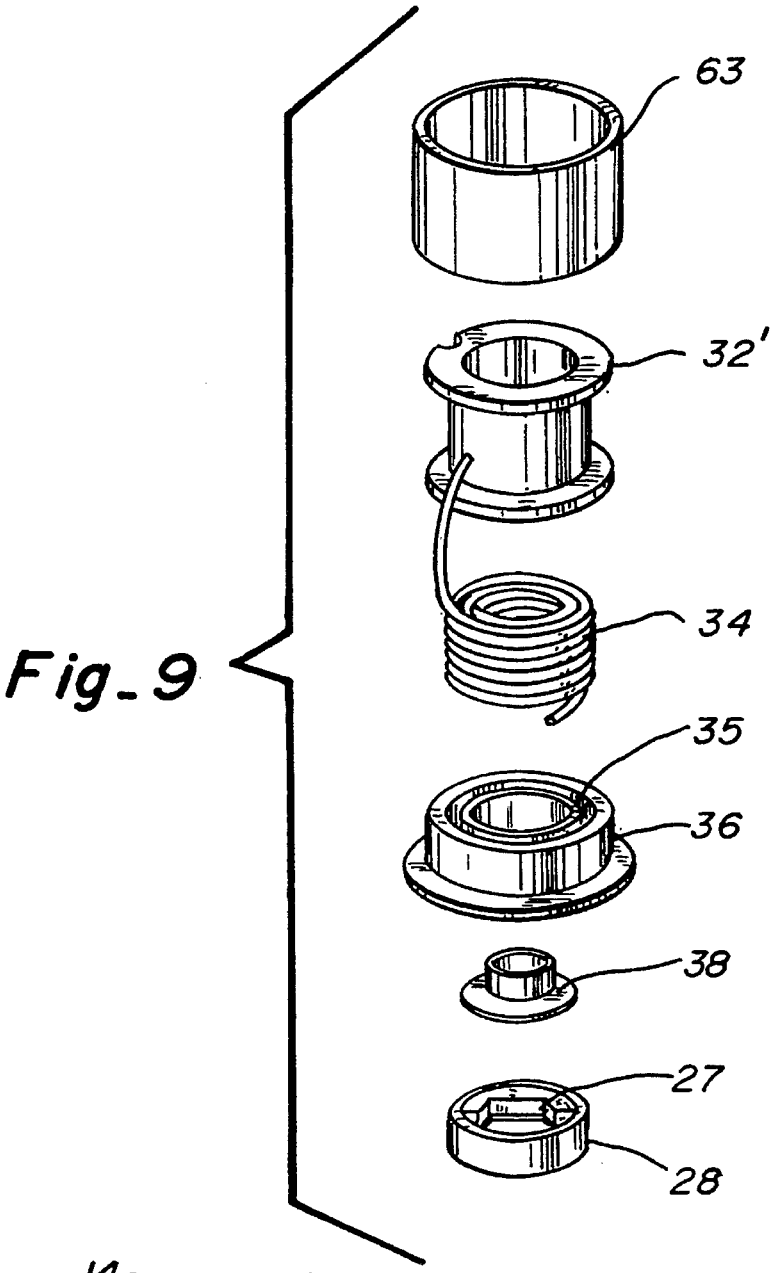
FIG. 9 is an exploded perspective view of the major components of an inductor assembly shown in FIG. 8.

The components of the assembly 20 are shown in exploded form in FIG. 9. The sleeve member 63 is positioned above the bobbin member 32' of the C-shaped cross section. The winding 34 is wrapped about the bobbin member 32'. A lower bobbin member 36, here forming a ring-shaped seating surface for seating of the bobbin member 32' thereupon is positioned beneath the bobbin member 32'. The lower bobbin member 36 is formed of a nonconductive, such as a plastic, material. The top surface of the lower bobbin member 36 preferably includes a recessed portion 35 to permit mated engagement with a bottom portion of the bobbin member 32' when the bobbin member 32' seats upon the lower bobbin portion 36. A small conductive eyelet 38 is again adapted for positioning between a conductive bridge 27 of the electronic control module 28 to interconnect the conductive bridge 27 to the lower end of the winding 34. In this embodiment, the control module 28 has an outer circumference to permit press fitting of the control module 28 and interior walls of the lower bobbin portion 36.

By controlling the length of the air gap 64 separating the sleeve member 63 and the bottom portion of the bobbin member 32', the inductance of the assembly 20 may be selected to be of an inductance level, as desired.

While not shown, in another embodiment, the assembly 20 includes a toroidal inductor having a winding wrapped about a toroid-shaped core of dimensions permitting positioning of the assembly 20 within the shell base 22 of the lamp bulb. The toroidal inductor is mounted upon a surface analogous to the top surface of the lower bottom portion 36 which is of dimensions permitting seating of the toroidal inductor thereupon. A conductive eyelet, similar to the conductive eyelet 38, is used to interconnect the toroidal inductor with an electronic control module.

Figure 10:
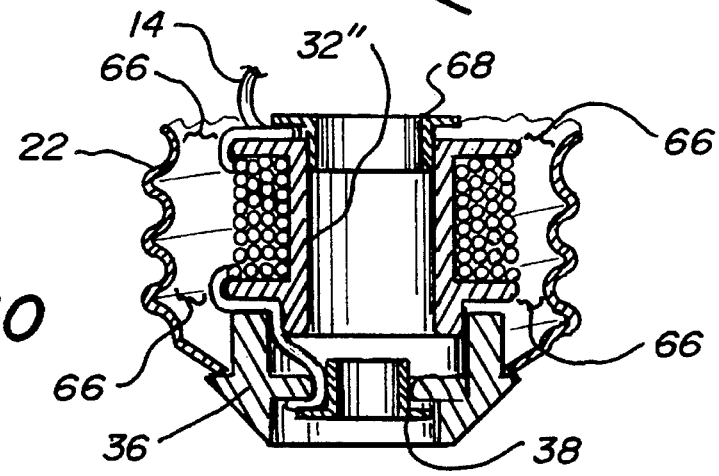
FIG. 10 is a sectional view of a portion of an incandescent lamp bulb of yet another preferred embodiment of the present invention.

FIG. 10 illustrates a portion of a lamp bulb of yet another embodiment of the present invention. In this embodiment, the shell base 22 of the lamp bulb is formed of a ferromagnetic material. The assembly 20 includes a bobbin member 32", again of a C-shaped cross section and a winding 34 wrapped thereabout. The diameter of the bobbin member 32" is somewhat greater than the diameter of the bobbin member 32' shown in FIGS. 8 and 9 and has circumferential portions positioned proximate to the ferromagnetic shell base 22. One or more air gaps 66 separate the bobbin member 32" and the shell base 22. A circulating magnetic flux path is formed between the bobbin 32" and the shell base 22. The air gaps 66 prevent core saturation of the assembly 20. By appropriate selection of the diameter of the bobbin member 32', the inductance of the assembly 20 may be selected as desired. Again, the bobbin member 32" seats upon a top surface of a bottom bobbin portion 36 formed of a nonconductive material. Eyelets 38 and 68 interconnect the winding 34 with an electronic control module (not shown in FIG. 10) and a filament wire 14.

Figure 11:
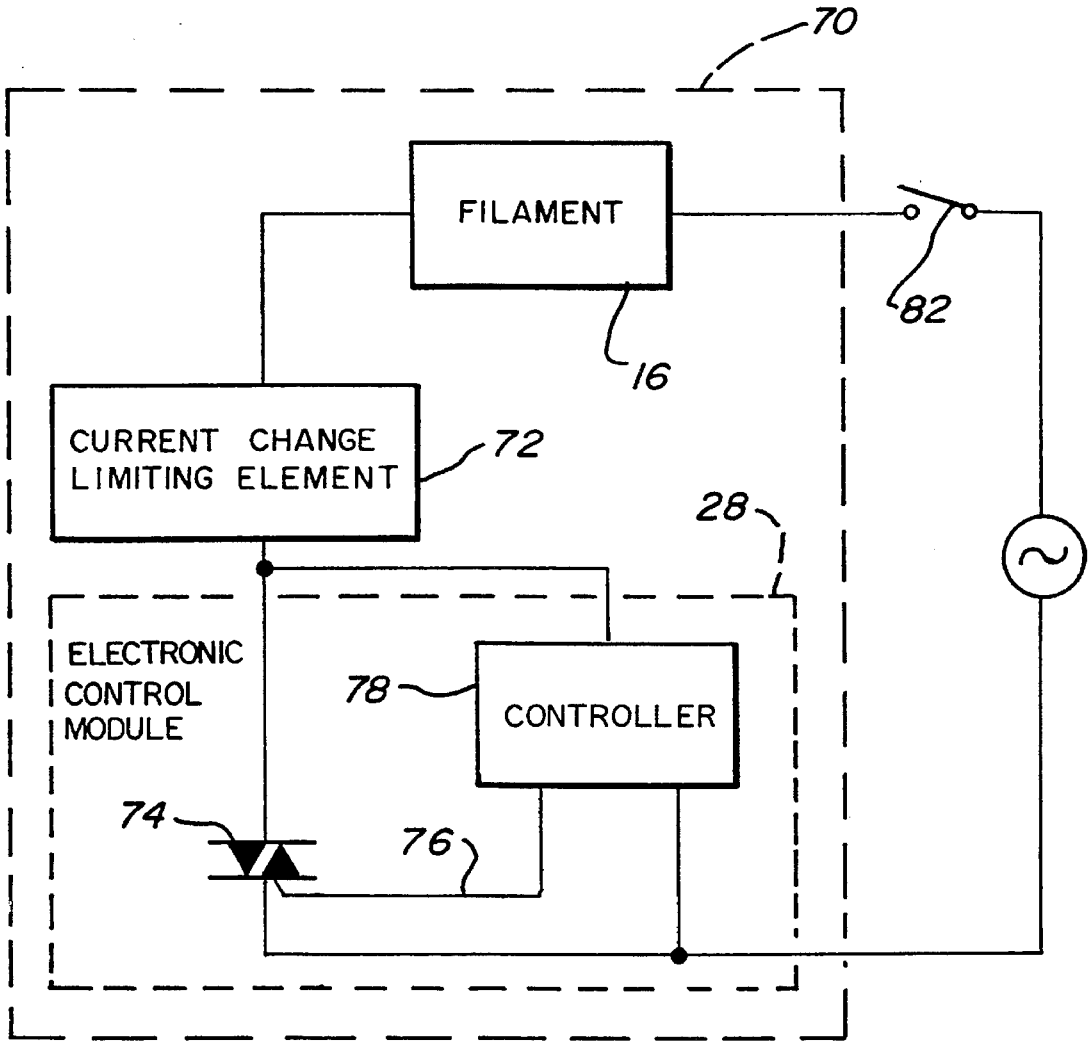
FIG. 11 is a block diagram showing additional aspects of the circuit shown in FIG. 5.

The incandescent lamp bulbs of any of the embodiments shown in FIGS. 1–4, 8–9, and 10 is shown generally at 70 in FIG. 11. The lamp bulb 70 includes a current change limiting element 72, for example the inductor assembly 20, and the filament 16 which are connected in series with the AC power source 40. The ECM 28 is also preferably included in the lamp bulb 70 in the manner previously described, but it is not required that the ECM 28 be included in all embodiments of the present invention. The ECM 28 includes a triac 74 which is controlled by signal applied to its gate terminal 76 by a controller 78. The triac 74 is connected in series with the current change limiting element 72 and the filament 16.

The controller 78 is preferably a conventional integrated circuit microcontroller or microprocessor which is programmed to recognize predetermined sequences of interruptions from the conventional AC power source 40 created by opening and closing a conventional switch 82. The controller 78 recognizes these predetermined sequences of power interruptions and correlates them to a particular preprogrammed lighting control function. The controller 78 thereafter triggers the triac 74 into conduction in relationship to each half cycle of applied AC voltage from the AC power source 40. By appropriate control of the times during each half cycle when the controller 78 generates the triac trigger signals, the current level in the filament 16 is controlled as desired to effectuate the preprogrammed lighting control functions, such as variable illumination intensity, variable timing, and variable duty cycle. More details concerning the ECM 28 and its lighting control functionality are available in U.S. Pat. No. 5,030,890. When the ECM 28 is not part of the lamp bulb 70, an dimmer or other control device external to the lamp bulb 70 is used, usually in place of the switch 82, and the current change limiting element 72 and the filament 16 are connected in series within the lamp bulb 70.

Figure 12:
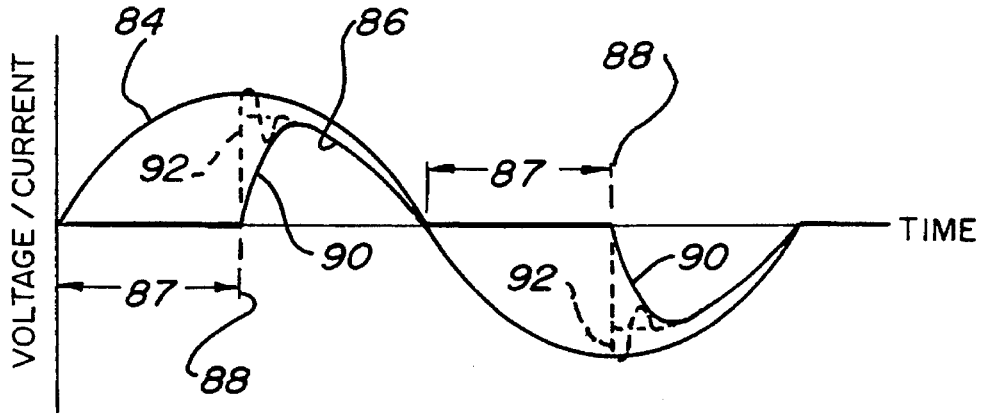
FIG. 12 is a graph illustrating the relationship between the voltage supplied to the circuit shown in FIG. 11 from an AC power source and the controlled current flow in the lamp bulb shown in FIG. 11.

FIG. 12 illustrates the relationship of the voltage 84 from each half cycle from the AC power source 80 and the current 86 conducted by the triac 74 through the filament 16 (FIG. 8) when triggered by the ECM 28 with the switch 82 closed. Curve 84 is a plot of the voltage applied across the lamp bulb 70 as a function of time, and curve 86 is an exemplary plot of the current conducted through the lamp bulb 70 as a function of time which will minimize conducted RFI, which results from the triac 74 being triggered during each half cycle of the applied voltage 84. The curve 92 illustrates the effect of the current change limiting element 72 on the current conducted by the lamp bulb 70.

When the triac 74 is in the nonconductive state, the triac creates a substantially open circuit, and no current flows through the lamp bulb 70, as indicated by times 87 of each half cycle of the curve 84. The triac 74 is triggered into conduction when the controller 78 generates a trigger signals on the gate terminal 76 at time 88. The triac 74 then becomes conductive to form a closed series circuit through the filament 16 and the current change limiting element 72 through the AC power source 80 (FIG. 8). The current level initially varies in response to the instantaneous magnitude of the voltage as represented by the curve 84 at time 88 and the current limiting capability of the element 72, and then after the element has achieved its limiting function (which is di/dt=0 of the inductor 20), by the voltage represented by the curve 84 after the maximum limiting capability is achieved.

The filament 16 and the current change limiting element 72 are operative to alter the rate at which the current level increases through the lamp bulb 70 when the triac 74 is triggered out of the nonconductive state and into the conductive state. By slowing the rate of current level increase, the emitted RFI is attenuated, preferably to a level not exceeding the maximum allowable levels permitted by the applicable electrical or health code. The effect of the filament 16 and the current change limiting element 72 is shown by the leading edge curve portions 90 of the curve 86 which show a gradual rise in current when the triac is triggered into the conductive state. Dashed curve segments 92 illustrate the increase in current which would otherwise occur without use of the current change limiting element 72, or improper selection of L-C values such as found in conventional dimmers. The rapid rate of increase of current indicated by the curve segments 92 can generate RFI which may exceed certain electrical or health code levels for RFI.

The current change limiting element 72 limits the rate at which the current level in the lamp bulb 70 change when the triac 74 is triggered into the conductive state. Because the current change limiting element 72 is preferably positioned within the screw shell base 22 of the incandescent lamp bulb shown in FIGS. 1, 8, or 10, the current change limiting element must be of small physical dimensions. While the physical dimensions of the current change limiting element 70 are, at least in part, dependent upon the current change limiting capacity of the element 70, appropriate selection of the current change limiting capacity of the element 70 will limit adequately the rate of current change but still retain relatively small physical dimensions.

The impedance or resistance of the filament 16 plays an important part in optimizing the RFI attenuation characteristics of the lamp bulb 70. The light intensity of an incandescent lamp bulb is typically rated by wattage. The wattage is established by the resistance of the filament 16. For a lamp bulb of any particular rated wattage powered by a conventional AC power source, the resistance of the lamp bulb is calculated by the equation:

$$R=E^2/P \tag{1}$$

wherein:

E is the RMS voltage of the AC power source; and

P is the rated wattage of the lamp bulb.

For example, a 60 watt lamp bulb operative on 120 volts has a hot filament resistance of 240 ohms. In another example, a 100 watt lamp bulb operative on 220 volts has a hot filament resistance of 484 ohms.

When selecting the inductance of the inductor assembly 20, the diameter of the wire forming the coil 34 must be great enough to avoid an unacceptable power loss. For a sixty watt lamp bulb having a characteristic impedance of 240 ohms, the diameter of the wire of the coil 34 should be in the range of 0.007 inches through 0.009 inches. A practical inductive value of a winding formed of by wire of a diameter in this range and fitting within a screw shell base is between 200 and 1,000 microhenrys.

Figure 13:
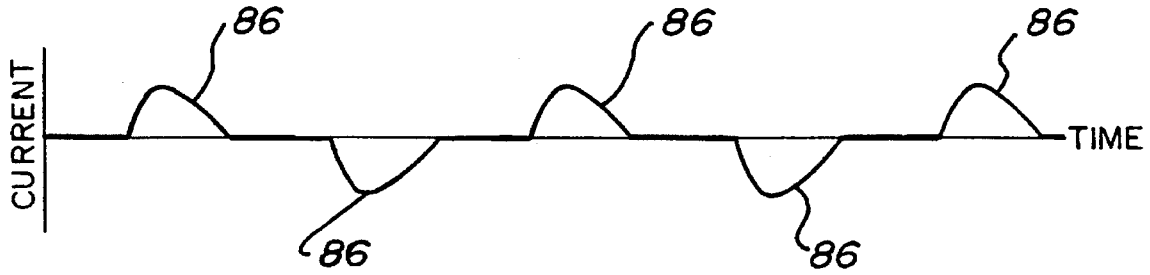
FIG. 13 is a graph representing the current conducted in the filament shown in FIG. 11 during several cycles of applied AC power.

FIG. 13 is a plot of several current pulses 86 (FIG. 9), shown over several sequential AC power half-cycle time periods. The result is a series of pulses 86 which form a periodic waveform which may be represented by the sum of an infinite number of harmonically related sine and cosine terms as is known in electrical signal theory. The waveform, x(t), is represented by the Fourier series equation:

$$x(t)=\frac{a_0}{2}+\sum_{n=1}^{\infty} a_n\cos n\omega_1 t+b_n\sin n\omega_1 t \tag{2}$$

where:

$$a_n=\frac{2}{T_s}\int_0^{T_s} f_1(t)\cos n\omega_1 t\,dt; \tag{3}$$

-continued $$b_n = \frac{2}{T}\int_0^{T_s} f_1(t)\sin n\omega_1 t dt; \tag{4}$$

and T is the period of the waveform;

$f_1$ is the fundamental cyclic frequency of the waveform;

$\omega_1$ is the fundamental radian frequency of the waveform; and n is an integer value representing the $n^{th}$ harmonic of the signal. $T_s$ and $\omega$ are the period and the frequency of the periodic signal with the following relationship;

$$\omega = \frac{2\pi}{T_s} \tag{5}$$

The amplitude of the Fourier transform of this signal is, $$Amp(n) = \sqrt{a_n^2 + b_n^2} \tag{6}$$

Using the fact that the current waveform conducted by a triac (shown in FIG. 10) is symmetric, i.e., $$f(t) = -f(t - T_s/2) \tag{7}$$

The change of variable in calculus shows that $a_n$ and $b_n$ have only the odd harmonic components and the even harmonics are cancelled.

$$a_n = \begin{cases} \frac{4}{T_s}\int_0^{T_s/2} f(t)\cos(n\omega t)dt & \text{if } n \text{ is odd} \\ 0 & \text{if } n \text{ is even} \end{cases} \tag{8}$$

-continued $$b_n = \begin{cases} \frac{4}{T_s}\int_0^{T_s/2} f(t)\sin(n\omega t)dt & \text{if } n \text{ is odd} \\ 0 & \text{if } n \text{ is even} \end{cases} \tag{9}$$

In this preliminary frequency spectrum analysis of the triac, a one-segment linear model is used. When the triac turns on at time $t_1$ (where the current is zero), the current will increase linearly with the slope s (in A/sec) and will intersect with the AC power sinusoidal signal at time $t_2$ satisfying the following equation (where $I_p$ is the peak current of the input sinusoidal signal), $$s(t_2 - t_1) = i_p \sin(\omega t_2) \tag{10}$$

Thus, for n being an odd integer, $a_n$ and $b_n$ will be (where $a_{n1}$ (or $b_{n1}$) and $a_{n2}$ (or $b_{n2}$) correspond to the first and second equation in the following expression of $a_n$ (or $b_n$), $$\begin{aligned} (1 \quad a_n &= \frac{4}{t_s}\int_{t_1}^{t_2} s(t-t_1)\cos(n\omega t)dt + \frac{4}{t_s}\int_{t_2}^{t_s/2} I_p\sin(\omega t)\cos(n\omega t)dt \\ &= a_{n1} + a_{n2} \\ 2) \quad b_n &= \frac{4}{t_s}\int_{t_1}^{t_2} s(t-t_1)\sin(n\omega t)dt + \frac{4}{t_s}\int_{t_2}^{t_s/2} I_p\sin(\omega t)\sin(n\omega t)dt \\ &= b_{n1} + b_{n2} \end{aligned} \tag{11}$$

The equations can be solved by using either an integration table or symbolic mathematical software as the following:

$$a_{n1} = \frac{4}{T_s}\frac{s}{n^2\omega^2}[(\cos(n\omega t_2) - \cos(n\omega t_1)) + n\omega w(t_2 - t_1)\sin(n\omega t_2)] \tag{13}$$

$$a_{n2} = \frac{4}{T_s}\left\{ -\frac{I_p}{2\omega(n+1)(n-1)}\left[(n-1)\cos\left(\frac{1}{2}(n+1)\omega T_s\right) - (n+1)\cos\left(\frac{1}{2}(n-1)\omega T_s\right)\right] + \frac{I_p}{2\omega(n+1)(n-1)}[(n-1)\cos((n+1)\omega t_2) - (n+1)\cos((n-1)\omega t_2)]\right\} \tag{14}$$

$$b_{n1} = \frac{4}{T_s}\frac{s}{n^2\omega^2}[(\sin(n\omega t_2) - \sin(n\omega t_1)) - n\omega(t_2 - t_1)\cos(n\omega t_2)] \tag{15}$$

$$b_{n2} = \frac{4}{T_s}\left\{ -\frac{I_p}{2\omega(n+1)(n-1)}\left[(n+1)\sin\left(\frac{1}{2}(n-1)\omega T_s\right) - (n-1)\sin\left(\frac{1}{2}(n+1)\omega T_s\right)\right] - \frac{I_p}{2\omega(n+1)(n-1)}[(n+1)\sin((n-1)\omega t_2) - (n-1)\sin((n+1)\omega t_2)]\right\} \tag{16}$$

These solution equations are quite complicated, making difficult or impossible a ready comprehension of the exact Fourier transform. To simplify matters, some approximations are useful in obtaining a meaningful approximation solution. In the derivation of the approximation solution below, assume that n is an odd integer:

$$\begin{aligned} a_{n1} &= \frac{4}{T_s}\frac{s}{n^2\omega^2}\left[-2\sin\left(n\omega\frac{t_2+t_1}{2}\right)\sin\left(n\omega\frac{t_2+t_1}{2}\right) + n\omega(t_2-t_1)\sin(n\omega t_2)\right] \\ &\simeq \frac{4}{T_s}\frac{s}{n^2\omega^2}\left[-2\sin\left(n\omega\frac{t_2+t_1}{2}\right) + n\omega(t_2-t_1)\sin(n\omega t_2)\right] \\ &= \frac{2_s}{\pi n^2\omega}\sin(n\omega t_2)\left[n\omega(t_2-t_1) - 2\sin\left(n\omega\frac{t_2-t_1}{2}\right)\right] \end{aligned} \tag{17}$$

where the approximation is used that there is a small difference between the values of $t_1$ and $t_2$, so that $$\sin\left(n\omega\frac{t_2+t_1}{2}\right)$$

is nearly equal to $\sin(n\omega t_2)$. For $a_{n2}$, there results:

$$\begin{aligned}
a_{n2} &= \frac{2I_p}{\omega T_s(n+1)(n-1)}\left\{(n+1)(-2)\sin\left[\frac{n-1}{2}\omega\left(\frac{T_s}{2}+t_2\right)\right]\sin\left[\frac{n-1}{2}-t_2\right)\right]- \right. \\
&\quad \left.\left(n-1(-2)\sin\left[\frac{n+1}{2}\omega\left(\frac{T_s}{2}+t_2\right)\right]\sin\left[\frac{n+1}{2}\omega\left(\frac{T_s}{2}-t_2\right)\right]\right\}\right. \\
&= \frac{4I_p}{\omega T_s(n+1)(n-1)}\left\{(n+1)\sin^2\left[(n-1)\omega\frac{t_2}{2}\right]-(n-1)\sin^2[(n+1)\omega t_2]\right\} \\
&\simeq \frac{-4I_p}{2\pi(n+1)(n-1)}\, n\sin(\omega t_2)\sin(n\omega t_2) \\
&\simeq \frac{-4I_p}{2\pi n^2}\, n\sin(\omega t_2)\sin(n\omega t_2)
\end{aligned} \tag{18}$$

where the term $n\sin(n\omega t_2)\sin(-\omega t)$ dominates over the two terms behind, $\sin^2[(n-1)\omega t_2/2]$ and $\sin^2[(n+1)\omega t_2/2]$. Combining $a_{n1}$ and $a_{n2}$ together:

$$a_n = \frac{-4s}{\pi n^2\omega}\sin(n\omega t_2)\left(n\omega\frac{t_2-t_1}{2}\right) \tag{19}$$

Using similar approximation procedures described above, for the $b_n$ approximation:

$$\begin{aligned}
b_{n1} &= \frac{4}{T_s}\,\frac{s}{n^2\omega^2}\left[2\sin\left(n\omega\frac{t_2-t_1}{2}\right)\cos\left(n\omega\frac{t_2-t_1}{2}\right)-n\omega(t_2-t_1)\cos(n\omega t_2)\right] \\
&\simeq \frac{4}{T_s}\,\frac{s}{n^2\omega^2}\left[2\sin\left(n\omega\frac{t_2-t_1}{2}\right)\cos(n\omega t_2)-n\omega(t_2-t_1)\cos(n\omega t_2)\right] \\
&= \frac{2s}{\pi n^2\omega}\cos(n\omega t_2)\left[-n\omega(t_2-t_1)+2\sin\left(n\omega\frac{t_2-t_1}{2}\right)\right]
\end{aligned} \tag{20}$$

$$\begin{aligned}
b_{n2} &= \frac{2I_p}{\omega T_s(n+1)(n-1)}\left\{(n+1)(2)\sin\left[\frac{n-1}{2}\omega\left(\frac{T_s}{2}-t_2\right)\right]\cos\left[\frac{n-1}{2}\omega\left(\frac{T_s}{2}+t_2\right)\right]- \right. \\
&\quad \left.(n-1)(2)\sin\left[\frac{n+1}{2}\omega\left(\frac{T_s}{2}-t_2\right)\right]\cos\left[\frac{n+1}{2}\omega\left(\frac{T_s}{2}+t_2\right)\right]\right\} \\
&= \frac{-4I_p}{\omega T_s(n+1)(n-1)}\left\{(n+1)\sin\left[(n-1)\omega\frac{t_2}{2}\right]\cos\left[(n-1)\omega\frac{t_2}{2}\right]- \right. \\
&\quad \left.(n-1)\sin\left[(n+1)\omega\frac{t_2}{2}\right]\cos\left[(n+1)\omega\frac{t_2}{2}\right]\right. \\
&= \frac{-4I_p}{\omega T_s(n+1)(n-1)}\left\{\frac{1}{2}n[\sin((n-1)\omega t_2)-\sin((n+1)\omega t_2)]+ \right. \\
&\quad \left.\frac{1}{2}\sin[(n-1)\omega t_2]+\frac{1}{2}\sin[(n+1)\omega t_2]\right\} \\
&\simeq \frac{2I_p}{\pi(n+1)(n-1)}\, n\sin(\omega t_2)\cos(n\omega t_2) \\
&\simeq \frac{2I_p}{\pi n^2}\, n\sin(\omega t_2)\cos(n\omega t_2)
\end{aligned} \tag{21}$$

Combining $b_{n1}$ and $b_{n2}$ together:

$$b_n = \frac{4s}{\pi n^2 w}\cos(nwt_2)\sin\left(nw\frac{t_2-t_1}{2}\right) \tag{22}$$

Thus, the amplitude of the Fourier transform of a triac is thus approximated:

$$\begin{aligned}
Amp(n) &= \sqrt{a_n^2+b_n^2} \\
&= \frac{4s}{\pi n^2\omega}\left|\sin\left(n\omega\frac{t_2-t_1}{2}\right)\right|
\end{aligned} \tag{23}$$

$$C_n = \frac{4s}{\pi N_n^2\omega}\cdot|\sin(n\omega(t_2-t_1))|\cdot I_p \tag{24}$$

where:

| | is the absolute value symbol.

$N_n$ is 120×an integer, n;

ω is the angular frequency of the periodic signal shown in FIG. 13;

s is the slope of the rising edges of the periodic signal shown in FIG. 13 and is also the value of the rate of current change, di/dt, of the current levels which form the periodic signal (for example, 60 in FIG. 7 and 90 in FIG. 12);

$t_2-t_1$ is a time difference between two points in time; and $I_p$ is a value of a peak current level.

From this relatively simple expression for the amplitude of the Fourier transform, appropriate values for the design parameters (e.g., which light intensity or the turn-on time $t_1$ and peak current, Ip) can be selected to get the desired frequency spectrum characteristics for fulfilling the particular electrical or health code standard.

The peak current level, $I_p$, is related to an RMS lamp current, $I_{lamp}$. Because the lamp current is related to the wattage rating and, hence, filament resistance of the lamp bulb, the peak current level, $I_p$, is also related to the filament resistance of the lamp bulb.

The noise spectrum, which is a plot of signal values of the amplitudes $C_n$, may be calculated and plotted for any particular slope. For example, when the value of s is $1\times10^6$ amperes/second, and the peak current level, $I_p$, is of a value of 0.643 amperes corresponding to a lamp wattage of 100 watts powered by a 220 volt power supply, the normalized noise spectrum 92, is plotted as shown in FIG. 14. The magnitude of the noise of the noise spectrum 92 is significant at frequencies at least as great as 700 kHz.

FIG. 15 is the plot of another normalized noise spectrum, shown as 94, when the slope, s, is $1\times10^5$ amperes/second, one order of magnitude less than that represented in FIG. 14. Examination of the noise spectrum 94 indicates that significant values of noise exist up to 200 kHz.

Comparison of the noise spectrums 92 and 94 indicates that the noise spectrum 92 has components of significant magnitudes which extend far higher in frequency than do components of the noise spectrum 94. The noise spectrums 92 and 94 therefore represent graphically the importance of reducing the rate of current level increase, i.e., the value of the slope, s, in the above equation, to prevent the generation of signals of significant amplitudes at radio frequencies.

FIG. 16 illustrates testing circuitry, shown at 102, which is used to measure actual voltage levels of the emitted RFI generated during operation of the lamp bulb 70. The testing circuitry 102 includes a 50 μH inductor 104 which is connected in series with the lamp bulb 70. The lamp bulb 70 is also connected across a 0.1 μF decoupling capacitor 106 and a spectrum analyzer 108 having a 50 ohm characteristic impedance (R). The power supply 40 supplies alternating current power to the lamp bulb 70.

A measured noise of RFI voltage level $V_{Mn}$ emitted by the lamp bulb 70 is determined by the equation:

$$V_{M_n} = V_n \cdot \frac{R}{\left(R + \frac{1}{\omega C}\right)} \tag{25}$$

where:

$V_n$ is the noise voltage measured across the spectrum analyzer having the characteristic impedance (R);

C is the capacitance of the decoupling capacitor 106; and

ω is $2\pi\times N_n$, where $N_n$ is a frequency harmonic.

Figure 17:
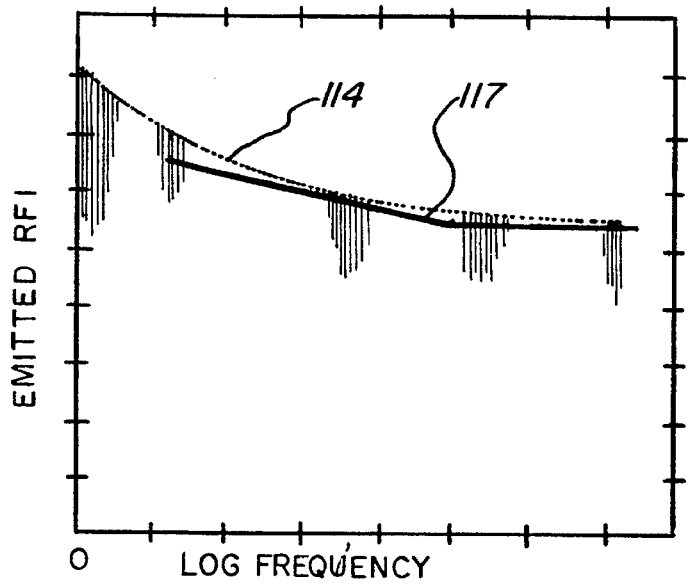
FIG. 17 is a graph illustrating RFI noise voltage plotted as a function of frequency for a lamp bulb which exhibits the RFI noise spectrum shown in FIG. 14.
Figure 18:
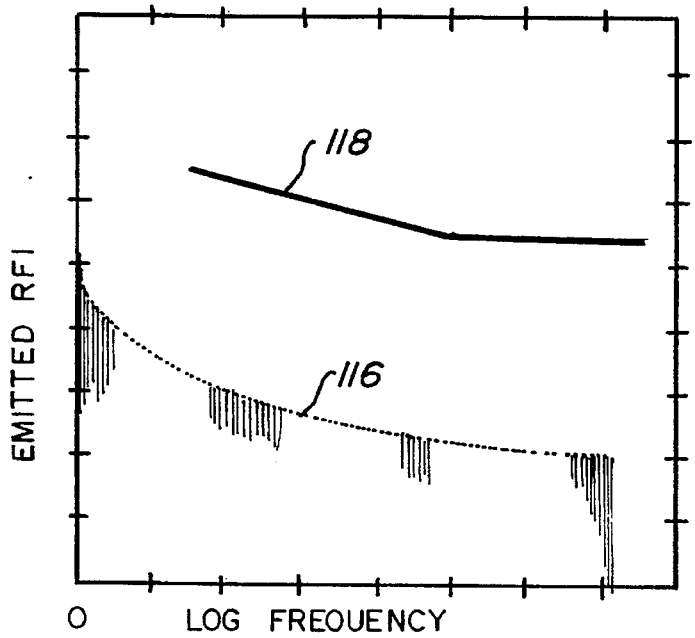
FIG. 18 is a graph illustrating RFI noise voltage plotted as a function of frequency for a lamp bulb which exhibits the RFI noise spectrum shown in FIG. 15.

For any selected frequency harmonic, the measured noise voltage, $V_{Mn}$, may be determined and thus values of $V_{Mn}$ may be plotted in manners analogous to the noise spectrums 92 and 94 shown in FIGS. 14 and 15. FIG. 17 is a plot of the measured noise voltage, shown at 114, corresponding to the noise spectrum 92 shown in FIG. 14. FIG. 18 is a plot of the measured noise voltage, shown at 116, corresponding to the noise spectrum 94 shown in FIG. 15. Comparison of the plots 114 and 116 indicates that, at all frequency levels, the noise levels of the plot 114 are greater than the noise levels of the plot 116. It is clear, therefore, that reducing the current shape or di/dt causes a significant reduction in emitted RFI, since FIG. 18 illustrates a reduction in such emitted RFI. For comparison purposes, graph 118 in both FIGS. 17 and 18 show that maximum limit of emitted RFI permitted under an exemplary European electrical code, known as CISPR-14.

Figure 19:
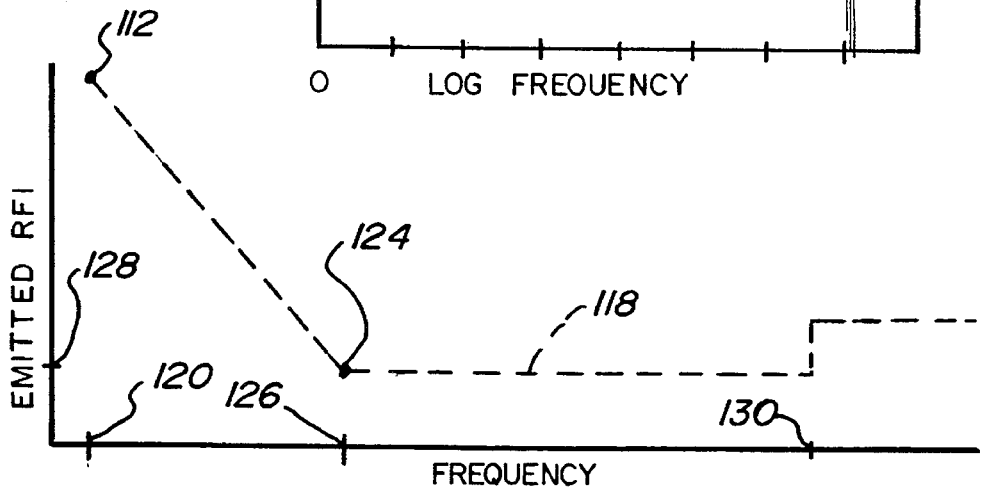
FIG. 19 is a graph of maximum levels of radiated RFI relative to frequency permitted by an exemplary electrical or health code.

FIG. 19 illustrates another graph 118 of the maximum allowable magnitude of RFI permitted to be generated by an electrical device at various frequencies according to the CISPR-14 electrical code. Below a first threshold frequency 120 the electrical code does not govern the emission of RFI. Beyond the first threshold frequency 120, RFI is limited to maximum permitted magnitudes at specific frequencies. At the first threshold frequency 120, the maximum permitted magnitude of RFI is shown at point 112. As the frequency level increases beyond the first threshold frequency 120, the maximum permitted magnitude decreases to point 124 at a second threshold frequency 126. Thereafter, with increasing frequencies, the maximum permitted RFI magnitude remains constant at the level 128 until a third threshold frequency 130 is reached. Therefore a somewhat higher magnitude of RFI is permitted.

The measured noise voltage levels, represented by plots 114 and 116, are related to the noise spectrums 92 and 94, and the noise spectrums 92 and 95 are dependent upon the slope, s, as described above. By determining the maximum value of C in equation which ensures that the noise voltage levels are less than maximum noise voltages permitted by an appropriate controlling code, the maximum permitted slope, s, or di/dt, may be calculated. By algebraic manipulation of equation (5), a solution may be obtained for s as follows:

$$s = \frac{di}{dt} = \frac{C}{4} \cdot \frac{\pi n^2 \omega}{|\sin(n\omega(t_2 - t_1))| \cdot I_p} \tag{26}$$

where the terms are as described previously.

It is also important to consider the time point within the periodic waveform at which the triac is turned on. If the lamp bulb is to emit relatively high light intensity, it will be turned on at or near the beginning of the occurrence of each half-cycle of the applied power waveform. Similarly, if the lamp bulb is to emit relatively low light intensity, it will be turned on near the ben of the occurrence of each half-cycle of the applied power waveform. In both the high intensity and low intensity situations, the triac turn on point will be under conditions of relatively low applied AC voltage, near the zero crossing points of the applied power waveform. Consequently the magnitude of noise generated at such times will be relatively low because the voltage or potential to generate the noise will be low. Thus emitted RFI under such conditions will be reduced.

On the other hand, turning on the triac near the mid point of the applied half-cycles of applied power, to obtain medium light intensity from the lamp bulb, will cause the maximum amount of emitted RFI. The emission of RFI is at its maximum because the peak voltage of each half-cycle of applied AC power occurs at this time. Thus the maximum amount of RFI occurs during conditions of medium intensity light emission.

The voltage across an inductor is governed by the equation:

$$V = L di/dt \tag{27}$$

wherein:

V is the voltage across the inductor;

L is the inductance of the inductor; and di/dt is the rate of change of current per unit of time in the inductor.

By inserting the value of di/dt calculated in equation (26) into equation (27), and solving equation (27) for L, the required inductance of the inductor 20 to ensure that the lamp bulb 70 does not generate RFI of levels greater than the levels permitted by an appropriate electrical or health code is calculated. In this manner, the size of the inductor 20 can be optimized for a lamp bulb of any particular wattage rating. Because the optimum value of the inductor forming the current change limiting element 72 is related to the resistance of a lamp bulb of a particular wattage rating, the inductor is optimally sized for the particular filament resistance of a particular lamp bulb. The physical dimensions required of the inductor for a lamp bulb of any particular wattage rating are thereby minimized while achieving optimum RFI suppression. As noted previously, the inductor may also form a portion of a second order filter to cause additional reduction in the rate of current level change during operation of the lamp bulb 70.

Various modifications may be made in and to the above described embodiment without departing from the scope of this invention. For example, various types of magnetic materials may be utilized in the formation of the inductive assembly described, and the various constructional changes may be made in the particular way that the inductive coil is mounted around the lamp exhaust tube and connected to the filament wires therein. Accordingly, these and other constructional and circuit modifications may be made by those skilled in the art without departing from the spirit and scope of the following appended claims.

The invention claimed is:

1. In an incandescent lamp having a translucent housing and a filament within the housing for emitting light when energized by electrical current from an AC power source passing through the filament, an improvement in combination therewith comprising:

a current change limiting element, comprising of an inductor assembly, located within the lamp and electrically connected to the filament and operative to limit the rate of change in current per change in time (di/dt) passing through the filament to a predetermined di/dt value in response to a substantially instantaneous change in voltage from the AC power source applied substantially instantaneously across the filament, the predetermined di/dt value limiting radio frequency interference (RFI) inherently emitted as a result of the di/dt in the filament in response to the substantially instantaneous change in voltage, the predetermined di/dt value having a value no greater than that value calculated according to the equation:

$$\frac{di}{dt} = \frac{C}{4} \cdot \frac{\pi N_n^2 \omega}{|\sin N_n \omega (t_2 - t_1)| \cdot I_p}$$

where:

C is a maximum permitted current amplitude;

$N_n$ is 120 times an integer, n, where n represents the $n^{th}$ harmonic of the signal;

ω is a value of the frequency at which electrical current is passed through the filament;

$t_2 - t_1$ is a time differential between the time point $t_1$ when the substantially instantaneous change in voltage is applied across the current change limiting element and the time point $t_2$ when the di/dt reaches a maximum magnitude; and $I_p$ is a value of a peak current level of the electrical current passing through the filament, established by the maximum value of the voltage of the AC power source and a resistance of the filament.

2. In an incandescent lamp as defined in claim 1, wherein:

the current change limiting element comprises an inductor.

3. In an incandescent lamp as defined in claim 2, wherein the value of the inductance is determined by the equation:

$$L = E/di/dt$$

where:

di/dt is the predetermined di/dt value; and

E is the RMS voltage of the AC power source.

4. In an incandescent lamp as defined in claim 1, wherein:

the value of C is related to the maximum voltage level of RFI permitted by an electrical or health code.

5. A method of restricting emitted radio frequency interference emitted from an incandescent lamp having a translucent housing and a filament within the housing for emitting light when the lamp is energized by electrical current from an AC power source passing through the filament, comprising the steps of:

locating a current change limiting element, comprising of an inductor assembly, within the lamp;

electrically connecting the filament to the current change limiting element;

limiting a rate of change in current per change in time (di/dt) passing through the filament by selecting the current change limiting element to have characteristics to establish the rate of change in current per change in time (di/dt) passing through the filament to a predetermined di/dt value in response to a substantially instantaneous change in voltage from the AC power source applied substantially instantaneously across the filament;

establishing the predetermined di/dt value to limit radio frequency interference (RFI) inherently emitted as a result of the di/dt in the filament in response to the substantially instantaneous change in voltage applied across the filament; and mathematically calculating a maximum value for the predetermined di/dt value according to the equation:

$$\frac{di}{dt} = \frac{C}{4} \cdot \frac{\pi N_n^2 \omega}{|\sin N_n \omega (t_2 - t_1)| \cdot I_p}$$

where:

C is a maximum permitted current amplitude;

$N_n$ is 120 times an integer, n, where n represents the $n^{th}$ harmonic of the signal;

ω is a value of the frequency at which electrical current is passed through the filament;

$t_2 - t_1$ is a time differential between the time point $t_1$ when the substantially instantaneous change in voltage is applied across the current change limiting element and the time point $t_2$ when the di/dt reaches a maximum magnitude; and $I_p$ is a value of a peak current level of the electrical current passing through the filament, established by the maximum value of the voltage of the AC power source and a resistance of the filament.

6. In an incandescent lamp as defined in claim 1, wherein:

the predetermined di/dt value has a value no greater than a maximum value established by mathematical calculation employing a Fourier series transform of a waveform of pulses of current conducted through filament during each half cycle of AC power from the AC power source when the instantaneous change of voltage applied across the filament is the maximum available during each half cycle of AC voltage applied by the AC power source.

7. In an incandescent lamp as defined in claim 1, wherein:

the current change limiting element limits the rate of the change in the current per the change in time through the filament to cause levels of RFI to be within maximum allowable levels permitted by an electrical or health code.

8. In an incandescent lamp as defined in claim 6, wherein:

the current change limiting element limits the rate of the change in the current per the change in time through the filament to cause levels of RFI to be within maximum allowable levels permitted by an electrical or health code.

9. A method as defined in claim 5, further comprising the steps of:

using an inductor as the current change limiting element.

10. A method as defined in claim 9, further comprising the steps of:

determining the value of the inductance by the equation:

$$L=E/di/dt$$

where:

di/dt is the predetermined di/dt value; and

E is the RMS voltage of the AC power source.

11. A method as defined in claim 5, further comprising the steps of:

relating the value of C to the maximum voltage level of RFI permitted by an electrical or health code.

12. A method as defined in claim 5, further comprising the steps of:

limiting with the current change limiting element the di/dt through the filament to cause levels of RFI to be within maximum allowable levels permitted by an electrical or health code.

13. In an incandescent lamp bulb having a light-generative filament for generating light when the lamp bulb is powered with electrical energy generated at an electrical power source and a longitudinally-extending lamp exhaust tube, a combination with the light-generative filament of a current change limiting element positionable in electrical connection with the light-generative filament for limiting rates of current level change of electrical energy applied to the light-generative filament, said current change limiting element comprising:

a core of ferromagnetic material having a central aperture extending therethrough to permit positioning of the core of ferromagnetic material about the lamp exhaust tube, the central aperture defining a top opening at a top surface of the core of ferromagnetic material and a bottom opening at a bottom surface of the core of ferromagnetic material;

a winding wrapped about the core of ferromagnetic material; and a magnetic flux path positioned about at least a portion of the winding between the top surface of the core and the bottom surface of the core wherein the core of ferromagnetic material, the winding, and the magnetic flux path together define part of an inductor assembly of a selected inductance.

14. The combination of claim 13 wherein said core of ferromagnetic material comprises a bobbin member.

15. The combination of claim 13 wherein said magnetic flux path comprises a sleeve element formed of a ferromagnetic material positioned about at least a portion of the winding.

16. The combination of claim 13 wherein the magnetic flux path comprises portions of a screw shell base forming a portion of the lamp bulb.

* * * * *